US008376252B1

(12) United States Patent
Hockmeyer et al.

(10) Patent No.: US 8,376,252 B1
(45) Date of Patent: Feb. 19, 2013

(54) PRODUCING NANOMETER-RANGE PARTICLE DISPERSIONS

(75) Inventors: Herman H. Hockmeyer, Saddle River, NJ (US); Barry W. Cullens, Elizabeth City, NC (US); Benjamin G. Roberts, Elizabeth City, NC (US); Michael William Turner, Elizabeth City, NC (US)

(73) Assignee: Hockmeyer Equipment Corp., Harrison, NJ (US)

( * ) Notice: Subject to any disclaimer, the term of this patent is extended or adjusted under 35 U.S.C. 154(b) by 0 days.

(21) Appl. No.: 13/613,078

(22) Filed: Sep. 13, 2012

(51) Int. Cl.
*B02C 23/08* (2006.01)
*B02C 17/22* (2006.01)

(52) U.S. Cl. ..... 241/21; 241/172

(58) Field of Classification Search ..... 241/21, 241/46.17, 46.017, 171, 172
See application file for complete search history.

(56) References Cited

U.S. PATENT DOCUMENTS 5,184,783 A * 2/1993 Hockmeyer et al. ..... 241/172
5,497,948 A 3/1996 Hockmeyer
5,820,040 A 10/1998 Hockmeyer et al.
5,934,579 A * 8/1999 Hiersche et al. ..... 241/65
6,029,915 A * 2/2000 Inoue ..... 241/17
6,325,310 B1 * 12/2001 Inoue ..... 241/46.01
7,175,118 B2 * 2/2007 Hockmeyer ..... 241/46.17
7,275,704 B2 * 10/2007 Araki ..... 241/172
7,559,493 B1 7/2009 Hockmeyer et al.
7,828,234 B1 11/2010 Hockmeyer et al.
7,883,036 B1 2/2011 Cullens et al.
7,914,200 B1 3/2011 Hockmeyer et al.
8,182,133 B1 5/2012 Hockmeyer et al.

* cited by examiner

*Primary Examiner* — Faye Francis
(74) *Attorney, Agent, or Firm* — Arthur Jacob

(57) ABSTRACT

Apparatus and method are disclosed for producing nanometer-range particle dispersions utilizing an immersion mill having a rotor for processing feedstock within a bed of media contained within a containment wall. An auxiliary chamber provides a chamber wall surrounding the containment wall and feedstock is passed from the bed of media, through the containment wall and into the auxiliary chamber while the media is contained within the bed of media. The feedstock is drawn from the bed of media, through the containment wall, and out of the auxiliary chamber, with an external pumping mechanism arranged for operation independent ofrotation of the rotor, whereby the containment wall is maintained unbroken by any direct connection between the rotor and the external pumping mechanism and remains effective in containing the media within the bed of media.

20 Claims, 4 Drawing Sheets

PRODUCING NANOMETER-RANGE PARTICLE DISPERSIONS

BACKGROUND OF THE INVENTION

1. Field of the Invention

The present invention relates generally to producing dispersions of finely divided particles within a liquid carrier and pertains, more specifically, to apparatus and method for the production of particle dispersions in which particle size is within a range measured in nanometers.

The technology wherein dispersions are produced by utilizing a field of media in which solids are ground within liquids has demonstrated that the quality of such dispersions can be enhanced by significantly reducing the size of the particles present in the finished dispersion. Immersion mills, such as those of the type described in U.S. Pat. No. 5,184,783, the disclosure of which is incorporated herein by reference thereto, have been employed to process feedstock through a bed of media to create dispersions of consistent high quality. However, efforts to increase even further the quality of such dispersions by reducing particle size down to a range measured in nanometers, that is, to a size less than one micron in diametric dimensions, have met with difficulties in separating the very small media required in the media field from the feedstock during the conduct of the grinding process. Conventional apparatus and method which utilize screening devices or gap separation devices for separating the media from the feedstock and confining the media to the bed of media tend to clog readily, thereby reducing flow and providing very low levels of throughput.

2. Description of Related Art

The problem of reduced flow and concomitant low levels of throughput has been addressed successfully by the use of immersion mills provided with porous containment walls, as described in U.S. Pat. Nos. 7,828,234 and 7,883,036, the disclosures of which are incorporated herein by reference thereto. However, it has been found that upon reducing the size of the media employed in such immersion mills into the range of sizes required to attain a dispersion wherein particle size is in the nanometer range, even though the containment wall is effective in precluding escape from the media field of the very small media necessary for the conduct of such a process, the very small media have found an alternate path of escape, namely, through manufacturing tolerances existing at the lower bearing that provides an internal support for the bottom impeller employed in such immersion mills, as illustrated in the aforesaid U.S. Pat. No. 5,184,783, wherein a bottom impeller (150) is supported by a bearing (86). Thus, where the media size is reduced to below about 0.3 mm, media can find a path out of the media field, through the clearance provided by the tolerances present between the bearing and the rotating shaft that extends through the bearing. While a hub construction as described in U.S. Pat. No. 7,559,493, the disclosure of which is incorporated herein by reference thereto, has been found effective in deflecting media away from such an escape path where the media falls within a size range of no less than about 0.3 mm, the construction described in U.S. Pat. No. 7,559,493 has been found unable to preclude the migration and escape of media having diametric dimensions less than about 0.3 mm, particularly when the media field is at rest and the hub is not rotating.

BRIEF SUMMARY OF THE INVENTION

The present invention addresses the problem of media migration and escape by eliminating the bottom impeller entirely, and with it the necessity for a corresponding bottom support comprised of a shaft and bearing, thereby eliminating any corresponding media escape path, regardless of the size of the media. As such, the present invention attains several objects and advantages, some of which are summarized as follows: Enables enhancement of the quality of dispersions wherein solids are ground within a field of media into a liquid carrier, by reducing the particle size within the dispersion to within a nanometer range, that is, to a particle size of less than one micron, while effectively confining the necessarily very small media within a bed of media that provides the field of media; presents apparatus and method for producing dispersions wherein particle size is within a nanometer range, utilizing an immersion mill in which a bed of media provides a field of very small media, confined within the bed of media so as to preclude the escape of media from the immersion mill in connection with conducting a processing operation; effectively separates the very small media necessary for the processing of nanometer-range particle dispersions from feedstock during the conduct of a processing operation in an immersion mill so as to confine the media to the media field contained within the immersion mill; increases the activity of a media field during the production of nanometer-range particle dispersions in an immersion mill to enhance throughput for reduced production cycle times; attains a more thorough mixing of particles within feedstock during a dispersion process, while providing for the transfer of heat out of or into the feedstock during processing; enables increased versatility in the ability to select from a wider variety of batch sizes accommodated by a single apparatus; allows enhanced control over the production of nanometer-range particle dispersions; enables increased ease of inspection, operation, clean-up and maintenance of apparatus for producing nanometer-range particle dispersions; provides apparatus and method for reliably producing nanometer-range dispersions of consistent high quality over an extended service life.

The above objects and advantages, as well as further objects and advantages, are attained by the present invention, which may be described briefly as apparatus for producing a nanometer-range particle dispersion utilizing an immersion mill having a rotor mounted for rotation within a containment wall for processing particle-carrying feedstock within a bed of media contained within the containment wall, the apparatus comprising: an auxiliary chamber having a chamber wall surrounding the containment wall such that feedstock will pass from the bed of media, through the containment wall and into the auxiliary chamber while the media is contained within the bed of media; and an external pumping mechanism communicating with the auxiliary chamber for drawing the feedstock from the bed of media, through the containment wall, and out of the auxiliary chamber, the external pumping mechanism being arranged for operation independent of the rotation of the rotor of the immersion mill, whereby the containment wall is unbroken by any direct connection between the rotor and the external pumping mechanism and remains effective in containing the media within the bed of media.

In addition, the present invention provides a method for producing a nanometer-range particle dispersion utilizing an immersion mill having a rotor mounted for rotation within a containment wall for processing particle-carrying feedstock within a bed of media contained within the containment wall, the method comprising: providing an auxiliary chamber having a chamber wall surrounding the containment wall; passing feedstock from the bed of media, through the containment wall and into the auxiliary chamber while containing the media within the bed of media; and drawing the feedstock from the bed of media, through the containment wall, and out of the auxiliary chamber, with an external pumping mechanism arranged for operation independent of rotation of the rotor of the immersion mill, whereby the containment wall is maintained unbroken by any direct connection between the rotor and the external pumping mechanism and remains effective in containing the media within the bed of media.

BRIEF DESCRIPTION OF THE SEVERAL VIEWS OF THE DRAWING

The invention will be understood more fully, while still further objects and advantages will become apparent, in the following detailed description of preferred embodiments of the invention illustrated in the accompanying drawing, in which.

DETAILED DESCRIPTION OF THE INVENTION

Figure 1:
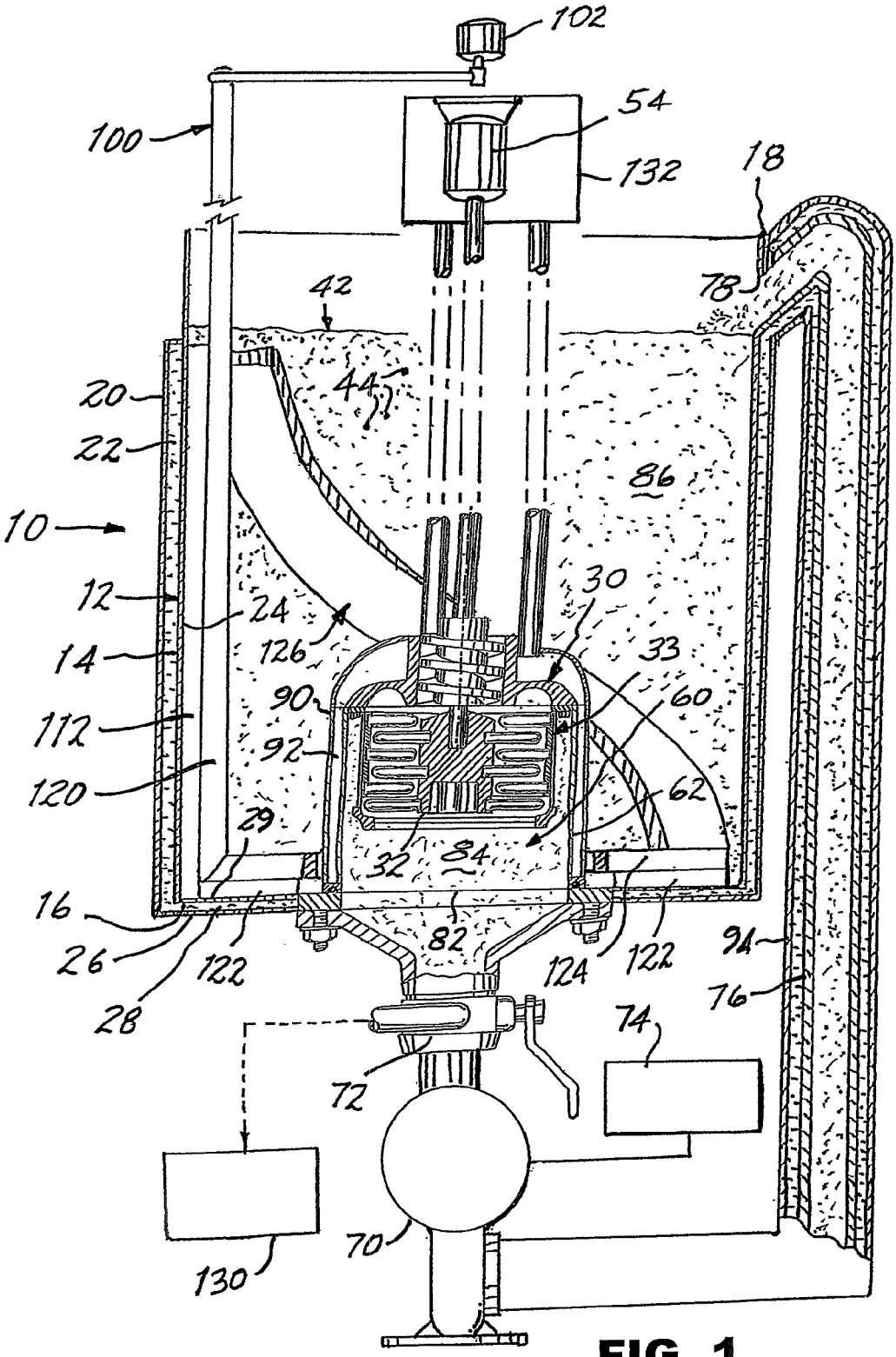
FIG. 1 is a somewhat diagrammatic, longitudinal cross-sectional view of an apparatus constructed in accordance with the present invention, for being operated in accordance with a method of the present invention.
Figure 2:
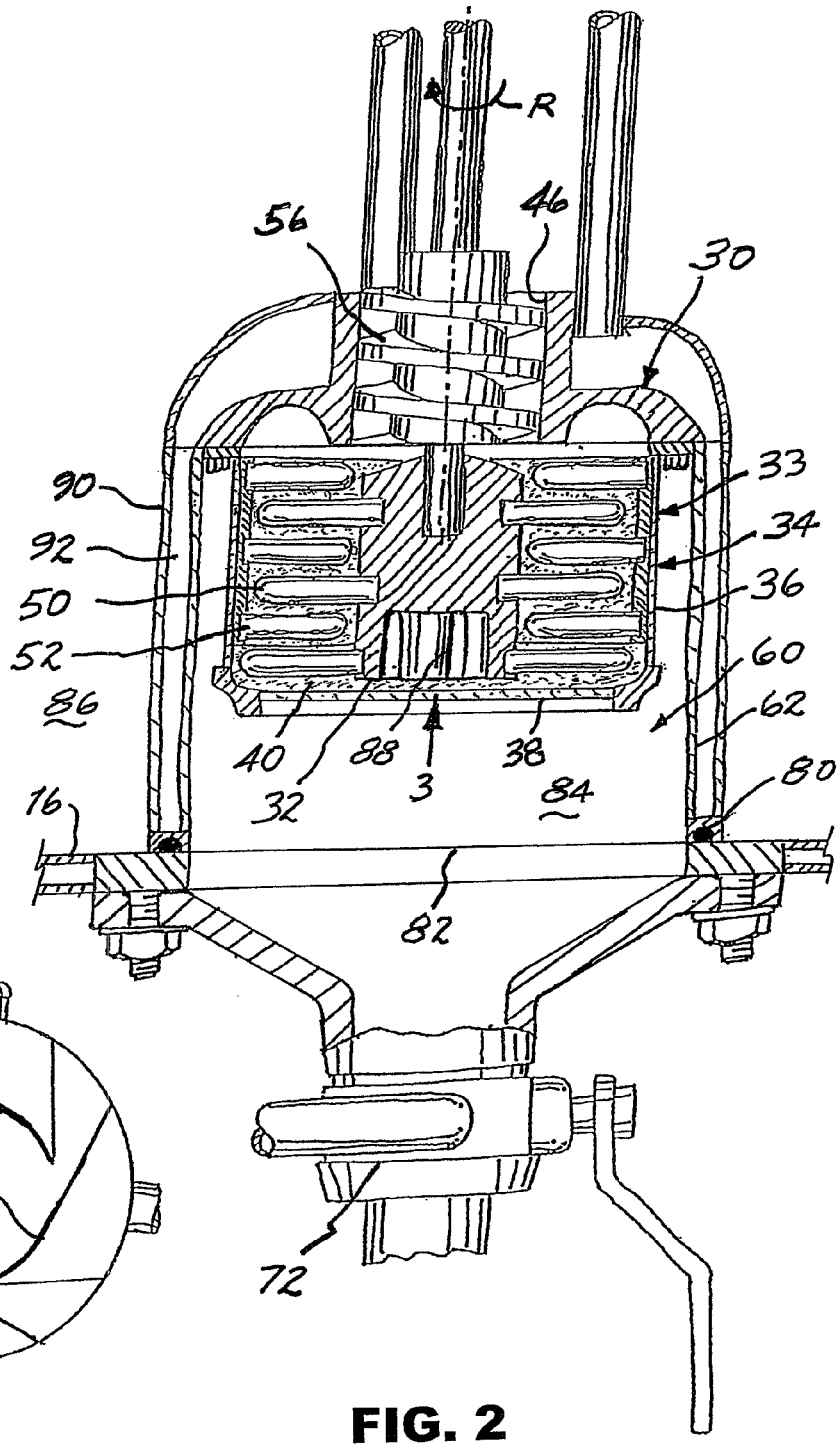
FIG. 2 is an enlarged fragmentary view of a portion of FIG. 1.

Referring now the drawing, and especially to FIGS. 1 and 2 thereof, an apparatus constructed in accordance with the present invention is shown at 10 and is seen to include a processing vessel 12 having a circular cylindrical vertical side wall 14 extending upwardly from a circular horizontal bottom wall 16 to a top end 18. A side jacket 20 surrounds the side wall 14 and is arranged for circulating a heat-exchange medium 22 in juxtaposition with vertical side wall 14 and heat transfer surface 24 provided by side wall 14. A bottom jacket 26 is juxtaposed with bottom wall 16 for circulating a heat-exchange medium 28 in juxtaposition with bottom wall 16 and heat transfer surface 29 provided by bottom wall 16.

An immersion mill 30, also known as a basket media mill, is located within processing vessel 12 and is seen to include a rotor 32 mounted for rotation within a basket 33 having a containment wall 34 with a cylindrical side containment wall 36 and a circular bottom containment wall 38, both the side wall 36 and the bottom wall 38 being constructed of a porous material for maintaining within the immersion mill 30 a bed 40 of media, all as described more fully in the aforesaid U.S. Pat. Nos. 7,828,230 and 7,883,036. As is now conventional in the production of particle dispersions, a particle-carrying liquid feedstock 42 is contained within processing vessel 12 and carries particles 44 which are to be reduced in size and mixed with the liquid of the feedstock 42 upon operation of the immersion mill 30. To that end, feedstock 42 enters immersion mill 30 at an inlet 46 and particles 44 are ground to a desired size by contact with the media within media bed 40, assisted by the action of pegs 50, which are moved by rotation of rotor 32, and counter-pegs 52 which remain stationary, as described more fully in U.S. Pat. No. 5,820,040, the disclosure of which is incorporated herein by reference thereto. Rotor 32 is rotated by a rotor drive 54, and the media within the media field of the media bed 40 is confined against escape through the inlet 46 by an auger 56, which is rotated along with rotor 32, as described in U.S. Pat. No. 7,175,118, the disclosure of which is incorporated herein by reference thereto.

As discussed above, in order to produce a particle dispersion in which the size of the particles within the dispersion is in the nanometer range, that is, less than one micron in diametric dimensions, it is necessary to employ a media field in which the size of the media is less than about 0.3 mm. In an immersion mill, the media field is provided by a media bed confined within the immersion mill as feedstock is passed through the media bed of the immersion mill during a processing operation. As described in the aforesaid U.S. Pat. Nos. 7,828,234 and 7,883,036, porous containment walls are available to preclude the migration and escape of even these very small media. In fact, media sizes of about 0.2 to 0.1 mm are accommodated readily, and containment walls are available to accommodate media sizes ranging below 0.05 mm. However, as set forth above, earlier immersion mills utilize an impeller located below the basket that contains the media bed, outside the containment wall, as described in the aforesaid U.S. Pat. No. 5,184,783, in order to establish a pressure differential for drawing the feedstock through the media field, and out of the media bed and the containment basket. In the earlier construction, the impeller is coupled for rotation with the rotor of the immersion mill by means of a shaft rotating within a bearing or otherwise passing through the bottom of the basket that contains the media bed. Where the size of the media falls below about 0.3 mm, the manufacturing tolerances along the bearing or bushing provide an escape route along which such small media can pass from the media bed and out of the containment basket.

In order to avoid the escape of media from media bed 40, apparatus 10 of the present invention includes no lower impeller and associated bearing or bushing. Instead, there is provided an auxiliary chamber 60 having a chamber wall 62 surrounding the side containment wall 36 and extending below the bottom containment wall 38 such that feedstock 42 will pass from the media bed 40, through the containment wall 34 and into auxiliary chamber 60 while the media is contained within the media bed 40 by the containment wall 34. Pressure within the auxiliary chamber 60 is reduced as a result of suction created by an external pumping mechanism shown in the form of an external pump 70 communicating with the auxiliary chamber 60 through a valve 72 placed between the pump 70 and the bottom wall 16 of the processing vessel 12. Pump 70 is operated by a controller 74, independent of the rotation of rotor 32, and feedstock 42 is drawn through media bed 40 and through containment wall 34 by the pressure differential created by pump 70 for passage out of the auxiliary chamber 60 and into a return line 76 through which the feedstock 42 is returned to the processing vessel 12 at an inlet port 78 adjacent top end 18. In the preferred embodiment, pump 70 is in the form of a pulsating pump that provides pulsations which add to the hyper-activity between the media field and the feedstock 42 as the feedstock 42 passes through the media bed 40 during a grinding operation, thereby enhancing the operation.

Figure 3:
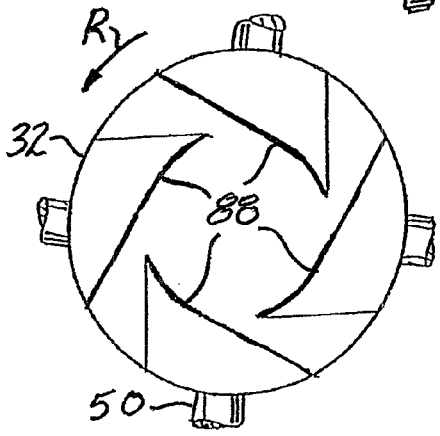
FIG. 3 is a further enlarged, fragmentary plan view of a detail taken in the direction indicated by arrow 3 in FIG. 2.

With the auxiliary chamber 60 in place within the processing vessel 12, as shown, a seal 80 is urged against the bottom wall 16 of the processing vessel 12 and closes open end 82 of the auxiliary chamber 60 so that the interior 84 of the auxiliary chamber 60 is sealed from the interior 86 of the processing vessel 12. During a processing operation, feedstock 42 is drawn from the interior 86 of the processing vessel 12 and into immersion mill 30, through inlet 46. Rotor 32 is rotated in a clockwise direction R by rotor drive 54 to establish the desired grinding action within basket 33, and feedstock 42 is passed through containment wall 34 and into auxiliary chamber 60, drawn by the suction established within auxiliary chamber 60 by pump 70. As best seen in FIGS. 2 and 3, the distribution of the flow of feedstock 42 through the bottom containment wall 38 is assisted by vanes 88 placed at the base of the rotor 32, which vanes 88 are juxtaposed with the bottom containment wall 38 and assist in directing feedstock 42 toward the bottom containment wall 38. Feedstock 42 passes through valve 72 and is moved by pump 70 through return line 76 and back to the interior 86 of processing vessel 12. Sealing of the open end 82 of auxiliary chamber 60 by seal 80 assures a complete and thorough turnover of the batch being processed. Chamber wall 62 is surrounded by a jacket 90 establishing an internal passage 92 for conducting a heat-exchange medium, and return line 76 is surrounded by another jacket 94 which also conducts a heat-exchange medium. Acting in concert with jackets 20 and 26 surrounding processing vessel 12, jackets 90 and 94 enable further control and regulation of the temperature of the feedstock 42 during a processing operation.

A consequence of decreasing particle size in a dispersion, and thereby increasing surface area of the solids mixed with the liquid in a feedstock, is the tendency toward dilatancy—a phenomenon that causes a normally free flowing dispersion to begin to pack, as the particles begin to fit more closely together and act as a solid mass, resistant to flow. Apparatus 10 counters dilatancy by gently agitating feedstock 42 away from the walls 14 and 16 of processing vessel 12 and slowly mixing the feedstock 42 scraped from the walls 14 and 16 with the remainder of feedstock 42 within the processing vessel 12 so as to return that feedstock 42 to the immersion mill 30. To that end, apparatus 10 includes a blade assembly 100 rotated by a rotating mechanism 102 concentrically around the immersion mill 30 and carrying scraper blades, as described in connection with the apparatus disclosed in U.S. Pat. Nos. 7,914,200 and 8,182,133, the disclosures of which are incorporated herein by reference thereto. Thus, a side scraper blade 112 is carried by a vertical scraper blade support member 120, with the side scraper blade 112 in position to scrape feedstock 42 from vertical side wall 14 of processing vessel 12, and bottom scraper blades 122 are carried by a horizontal bottom scraper blade support member 124 in position to scrape feedstock 42 from bottom wall 16. The scraped feedstock 42 then is mixed with feedstock 42 in the interior 86 of processing vessel 12 and the so mixed feedstock 42 is directed toward the top end 18 of the processing vessel 12 by a helical sweeper blade 126, carried by the vertical and horizontal support members 120 and 124 of blade assembly 100, to be circulated to the immersion mill 30. At the same time, heat transfer surfaces 24 and 29 of the walls 14 and 16 of the processing vessel 12 are better exposed for facilitating heat transfer between the feedstock 42 and the heat-exchange mediums 22 and 28 circulated within jackets 20 and 26.

Valve 72 preferably is in the form of a three-way valve so that upon completion of a processing operation, valve 72 is operated into a position wherein a completed dispersion is delivered to a finished product station 130 where the completed dispersion is collected for further processing or for packaging and transport. Once the processing operation is completed, immersion mill 30 is lifted readily by a lifting mechanism 132, and the immersion mill 30 and chamber wall 62 are raised as a unit, providing access to the immersion mill 30 through open end 82 of the auxiliary chamber 60. In this connection, it is noted that during the conduct of a processing operation, the reduced pressure within the interior 84 of auxiliary chamber 60 establishes a biasing force that biases the chamber wall 62 toward the bottom wall 16 of the processing vessel 12, thereby maintaining an effective seal at seal 80 while retaining the auxiliary chamber in place without the necessity for any further connection between the auxiliary chamber 60 and the processing vessel 12 to retain the auxiliary chamber 60 in place within the processing vessel 12 during the processing operation. Upon completion of the processing operation, the biasing force that retains the auxiliary chamber 60 in place against the bottom wall 16 of the processing vessel 12 is terminated, thereby releasing the auxiliary chamber 60 for ready raising of the immersion mill 30 and the auxiliary chamber 60 as a unit. In this manner, disassembly, inspection and repair (if necessary) of the immersion mill 30 is facilitated, as well as a change or addition of media, or a change of containment wall 34, all with a high degree of visibility. In addition, clean-up and maintenance are accomplished with ease.

Figure 4:
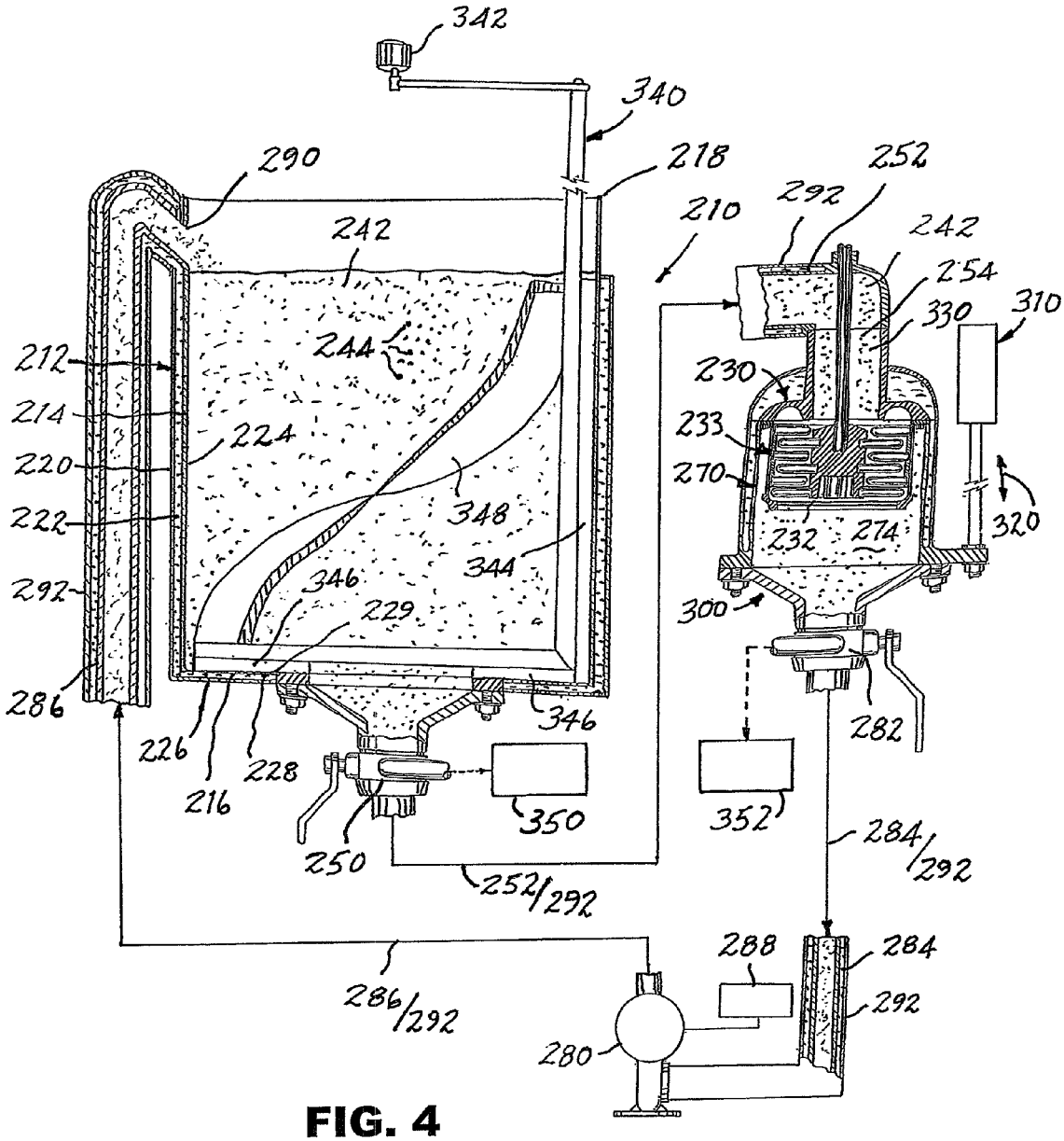
FIG. 4 is a somewhat diagrammatic, longitudinal cross-sectional view of another apparatus constructed in accordance with the present invention, for being operated in accordance with a method of the present invention.
Figure 5:
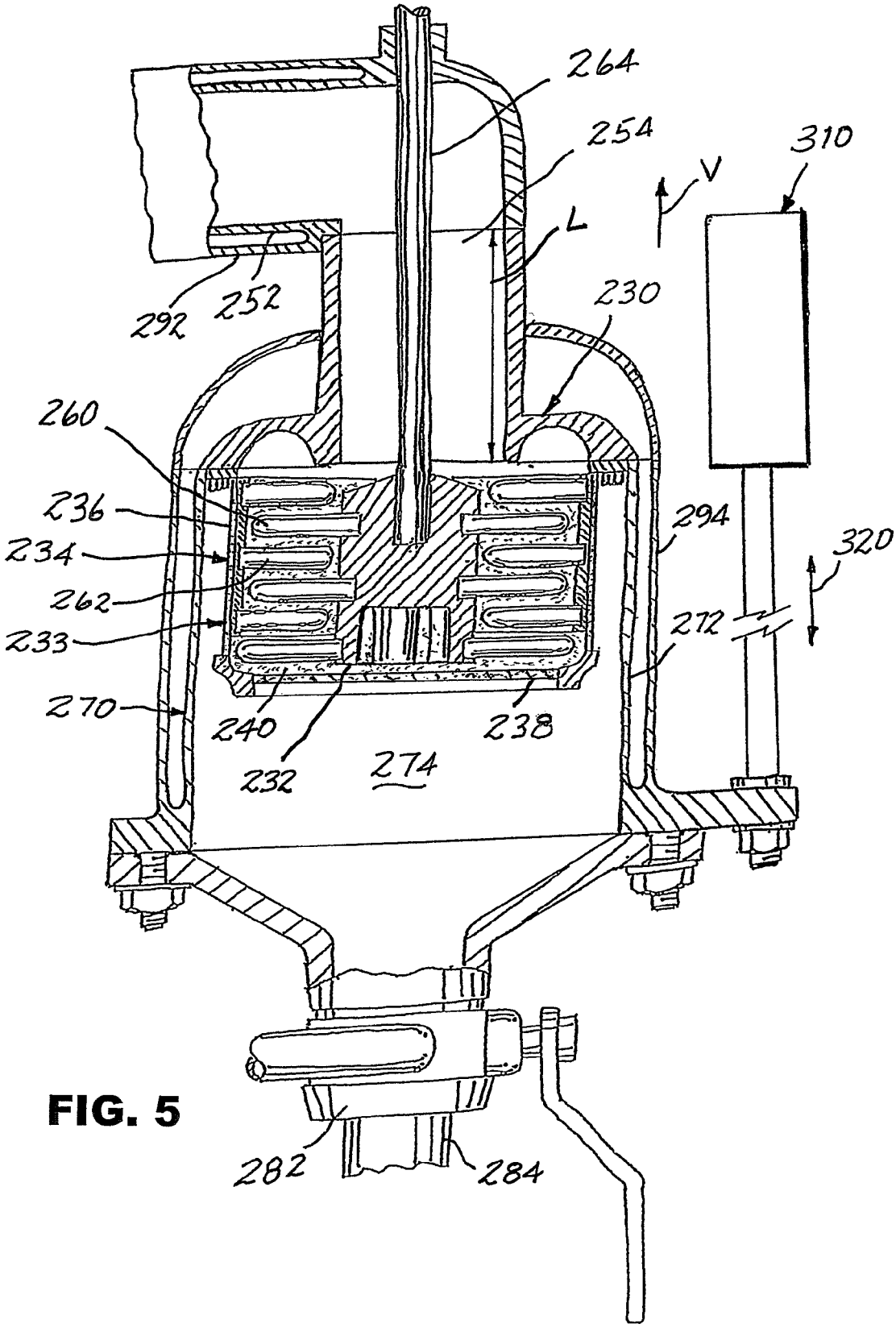
FIG. 5 is an enlarged fragmentary view of a portion of FIG. 4.

Referring now to FIGS. 4 and 5, another apparatus constructed in accordance with the present invention is shown at 210 and is seen to include a holding vessel 212 having a circular cylindrical vertical side wall 214 extending upwardly from a circular horizontal bottom wall 216 to a top end 218. A side jacket 220 surrounds the side wall 214 and is arranged for circulating a heat-exchange medium 222 in juxtaposition with vertical side wall 214 and heat transfer surface 224 provided by side wall 214. A bottom jacket 226 is juxtaposed with bottom wall 216 for circulating a heat-exchange medium 228 in juxtaposition with bottom wall 216 and heat transfer surface 229 provided by bottom wall 216.

An immersion mill 230, also known as a basket media mill, is located outside of holding vessel 212 and is seen to include a rotor 232 mounted for rotation within a basket 233 having a containment wall 234 with a cylindrical side containment wall 236 and a circular bottom containment wall 238, both the side wall 236 and the bottom wall 238 being constructed of a porous material for maintaining within the immersion mill 230 a bed 240 of very small media, all as described above in connection with apparatus 10. A particle-carrying liquid feedstock 242 is contained within holding vessel 212 and carries particles 244 which are to be reduced in size to a nanometer range, as described above, and mixed with the liquid of the feedstock 242 upon operation of the immersion mill 230. To that end, feedstock 242 is conducted to immersion mill 230 through a first valve 250 to a first conduit 252 communicating with an inlet passage 254 through which the feedstock 242 is passed into immersion mill 230, where particles 244 are ground to a desired size by contact with the media within media bed 240, assisted by the action of pegs 260, which are moved by rotation of rotor 232, and counter-pegs 262 which remain stationary, as described above in connection with apparatus 10. Rotor 232 is rotated by a rotor drive shaft 264. The media within the media field of the media bed 240 is confined against escape through the inlet passage 254 by providing the inlet passage 254 with a predetermined length L along a vertical direction V, as will be described in greater detail below.

Apparatus 210 includes an auxiliary chamber 270 having a chamber wall 272 surrounding the side containment wall 236 of the immersion mill 230 and extending below the bottom containment wall 238 such that feedstock 242 will pass from the media bed 240, through the containment wall 234 and into auxiliary chamber 260, while the media is contained within the media bed 240 by the containment wall 234. Pressure within the interior 274 of auxiliary chamber 270 is reduced as a result of suction created by an external pumping mechanism shown in the form of an external pump 280 communicating with the auxiliary chamber 270 through a second valve 282 and a second conduit 284 extending between the auxiliary chamber 270 and the pump 280. Pump 280 communicates with the holding vessel 212 adjacent the top end 218 through a return conduit 286. Pump 280 is operated by a controller 288, independent of the rotation of rotor 232, and feedstock 242 is drawn through media bed 240 and through containment wall 234 by the pressure differential created by pump 280 for passage out of the auxiliary chamber 260 and into the return conduit 286 through which the feedstock 142 is returned to the holding vessel 212 at an inlet port 290, thereby completing a circuit through which the feedstock 242 is circulated through apparatus 210. In the preferred embodiment, pump 280 is in the form of a pulsating pump that provides pulsations which add to the hyper-activity between the media field and the feedstock 242 as the feedstock 242 passes through the media bed 240 during a grinding operation. The conduits 252, 284 and 286 may be provided with jackets, as illustrated at 292, for conducting a heat-exchange medium to transfer heat between the feedstock 242 and the heat-exchange medium during a processing operation. In addition, jacket 294 conducts a heat-exchange medium to transfer heat at the chamber wall 272.

In the preferred embodiment, the conduits 252, 284 and 286 are flexible, and the immersion mill 230, auxiliary chamber 270 and second valve 282 are integrated into a unit 300 which is coupled with a elevator mechanism 310 for selective movement of the unit 300 upward and downward, along vertical direction V, relative to the holding vessel 212, as illustrated by arrow 320. In this manner, the feedstock 242 is fed from the holding vessel 212 to the immersion mill 230 by gravity, thereby eliminating the need for a separate feed pump that otherwise would be required to move the feedstock 242 from the holding vessel 212 to the immersion mill 230. At the same time, a level of feedstock 242 in the inlet passage 254 of the immersion mill 230 can be maintained sufficient to provide a column 330 of feedstock 242 within the inlet passage 254 having a length great enough to preclude an escape of media from the media bed 240 through the inlet passage 254. Further, the unrestricted construction of inlet passage 254 militates against clogs and facilitates the flow of feedstock 242 during a processing operation.

In utilizing apparatus 210, the volume of a batch to be processed can be selected from among small and large batches, independent of the size of the immersion mill 230. Thus, a smaller immersion mill 230 can process a large batch merely by running through a longer cycle time, while a larger immersion mill 230 can process a small batch, as long as the small batch is of a volume no less than that required to fill the immersion mill 230.

In a manner similar to that described above in connection with apparatus 10, dilatancy is avoided by gently agitating feedstock 242 away from the walls 214 and 216 of holding vessel 212 while mixing the feedstock 242 in the holding vessel 212. To that end, a blade assembly 340 is rotated by a rotating mechanism 342 and carries a side scraper blade 344 and bottom scraper blades 346, the side scraper blade 344 being in position to scrape feedstock 242 from side wall 214 and the bottom scraper blades 346 being in position to scrape feedstock 242 from bottom wall 216. Scraped feedstock 242 then is mixed with the remainder of feedstock 242 in the holding vessel 212 by a mixing blade in the form of a helical sweeper blade 348 carried within the blade assembly 340.

Once completed, a batch can be directed to a finished product station 350 by a selective operation of valve 250, or to a finished product station 352 by a selected operation of valve 282, each valve 250 and 282 being in the form of a three-way valve.

It will be seen that the present invention attains the several objects and advantages summarized above, namely: Enables enhancement of the quality of dispersions wherein solids are ground within a field of media into a liquid carrier, by reducing the particle size within the dispersion to within a nanometer range, that is, to a particle size of less than one micron, while effectively confining the necessarily very small media within a bed of media that provides the field of media; presents apparatus and method for producing dispersions wherein particle size is within a nanometer range, utilizing an immersion mill in which a bed of media provides a field of very small media, confined within the bed of media so as to preclude the escape of media from the immersion mill in connection with conducting a processing operation; effectively separates the very small media necessary for the processing of nanometer-range particle dispersions from feedstock during the conduct of a processing operation in an immersion mill so as to confine the media to the media field contained within the immersion mill; increases the activity of a media field during the production of nanometer-range particle dispersions in an immersion mill to enhance throughput for reduced production cycle times; attains a more thorough mixing of particles within feedstock during a dispersion process, while providing for the transfer of heat out of or into the feedstock during processing; enables increased versatility in the ability to select from a wider variety of batch sizes accommodated by a single apparatus; allows enhanced control over the production of nanometer-range particle dispersions; enables increased ease of inspection, operation, clean-up and maintenance of apparatus for producing nanometer-range particle dispersions; provides apparatus and method for reliably producing nanometer-range dispersions of consistent high quality over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An improvement in an apparatus for producing a nanometer-range particle dispersion utilizing an immersion mill having a rotor mounted for rotation within a containment wall for processing particle-carrying feedstock within a bed of media contained within the containment wall, the improvement comprising:

an auxiliary chamber having a chamber wall surrounding the containment wall such that feedstock will pass from the bed of media, through the containment wall and into the auxiliary chamber while the media is contained within the bed of media; and an external pumping mechanism communicating with the auxiliary chamber for drawing the feedstock from the bed of media, through the containment wall, and out of the auxiliary chamber, the external pumping mechanism being arranged for operation independent of the rotation of the rotor of the immersion mill, whereby the containment wall is unbroken by any direct connection between the rotor and the external pumping mechanism and remains effective in containing the media within the bed of media.

2. The improvement of claim 1 wherein the external pumping mechanism is located outside the auxiliary chamber.

3. The improvement of claim 1 wherein the external pumping mechanism comprises a pulsating pump.

4. The improvement of claim 3 wherein the external pumping mechanism is located outside the auxiliary chamber.

5. The improvement of claim 1 including a processing vessel for receiving a volume of feedstock to be processed, the auxiliary chamber being placed within the processing vessel for receiving feedstock directly from the volume of feedstock within the vessel, upon operation of the immersion mill.

6. The improvement of claim 5 wherein:

the processing vessel includes a vessel wall;

the chamber wall includes an open end; and the apparatus includes a sealing arrangement for sealing the open end of the chamber wall against the vessel wall upon placement of the auxiliary chamber against the vessel wall and operation of the pumping mechanism to draw feedstock out of the auxiliary chamber.

7. The improvement of claim 5 wherein the external pumping mechanism comprises a pulsating pump.

8. The improvement of claim 1 including a passage juxtaposed with the chamber wall for circulating a heat-exchange medium along the chamber wall.

9. The improvement of claim 1 including a vessel for receiving a volume of feedstock to be processed, the vessel including a vessel wall, and a scraper assembly mounted for movement within the vessel in place for scraping feedstock from the vessel wall upon operation of the immersion mill.

10. The improvement of claim 9 including a mixing blade assembly within the vessel in place for mixing scraped feedstock within the volume of feedstock in the processing vessel.

11. The improvement of claim 1 including a vessel for receiving a volume of feedstock to be processed, the auxiliary chamber being placed outside the vessel and in communication with the vessel for receiving feedstock from the volume of feedstock within the vessel upon operation of the immersion mill.

12. The improvement of claim 11 including an elevation mechanism for selective relative elevation in a vertical direction between the vessel and the auxiliary chamber to facilitate circulation of feedstock between the vessel and the auxiliary chamber.

13. The improvement of claim 12 wherein the immersion mill includes an inlet passage oriented in the vertical direction and having a predetermined length along the vertical direction, the predetermined length being sufficient to maintain within the inlet passage, during operation of the immersion mill, a column of feedstock that will preclude an escape of media from the bed of media, through the inlet passage.

14. The improvement of claim 11 including conduits for conducting the feedstock being circulated between the vessel and the auxiliary chamber, the conduits including jackets juxtaposed with the conduits for conducting a heat-exchange medium around the conduits.

15. A method for producing a nanometer-range particle dispersion utilizing an immersion mill having a rotor mounted for rotation within a containment wall for processing particle-carrying feedstock within a bed of media contained within the containment wall, the method comprising:

providing an auxiliary chamber having a chamber wall surrounding the containment wall;

passing feedstock from the bed of media, through the containment wall and into the auxiliary chamber while containing the media within the bed of media; and drawing the feedstock from the bed of media, through the containment wall, and out of the auxiliary chamber, with an external pumping mechanism arranged for operation independent of rotation of the rotor of the immersion mill, whereby the containment wall is maintained unbroken by any direct connection between the rotor and the external pumping mechanism and remains effective in containing the media within the bed of media.

16. The method of claim 15 wherein the external pumping mechanism is operated in a pulsating mode to transmit pulsations to the feedstock within the bed of media.

17. The method of claim 15 including providing a processing vessel for receiving a volume of feedstock to be processed, and placing the auxiliary chamber within the processing vessel for receiving feedstock directly from the volume of feedstock within the vessel, upon operation of the immersion mill.

18. The method of claim 15 including providing a vessel for receiving a volume of feedstock to be processed, and placing the auxiliary chamber outside the vessel and in communication with the vessel for receiving feedstock from the volume of feedstock within the processing vessel upon operation of the immersion mill.

19. The method of claim 18 including selecting a relative elevation in a vertical direction between the vessel and the auxiliary chamber to facilitate circulation of feedstock between the vessel and the auxiliary chamber.

20. The method of claim 19 including providing the immersion mill with an inlet passage oriented in the vertical direction and a predetermined length along the vertical direction sufficient to maintain within the inlet passage, during operation of the immersion mill, a column of feedstock that precludes an escape of media from the bed of media, through the inlet passage.

* * * * *